US009664040B2

(12) United States Patent
Glista

(10) Patent No.: US 9,664,040 B2
(45) Date of Patent: May 30, 2017

(54) COAL RECLAMATION APPARATUS AND METHOD

(76) Inventor: John J. Glista, Cranberry Township, PA (US)

( * ) Notice: Subject to any disclaimer, the term of this patent is extended or adjusted under 35 U.S.C. 154(b) by 3074 days.

(21) Appl. No.: 11/501,477

(22) Filed: Aug. 9, 2006

(65) Prior Publication Data

US 2008/0036268 A1 Feb. 14, 2008

(51) Int. Cl.
*E21C 45/00* (2006.01)

(52) U.S. Cl.
CPC ..... *E21C 45/00* (2013.01)

(58) Field of Classification Search
USPC ..... 299/17; 141/70
See application file for complete search history.

(56) References Cited

U.S. PATENT DOCUMENTS

| | | | | |
|---|---|---|---|---|
| 1,607,586 | A * | 11/1926 | Claytor | 299/5 |
| 3,930,846 | A | 1/1976 | Compton et al. | |
| 3,958,947 | A | 5/1976 | Robinson et al. | |
| RE28,945 | E | 8/1976 | Miscovich et al. | |
| RE29,021 | E | 11/1976 | Archibald et al. | |
| 3,990,748 | A * | 11/1976 | Ghusn et al. | 406/115 |
| 3,993,354 | A | 11/1976 | Kilroy | |
| 4,708,395 | A | 11/1987 | Petry et al. | |
| 5,181,578 | A | 1/1993 | Lawler | |
| 5,253,718 | A | 10/1993 | Lawler | |
| 5,879,057 | A | 3/1999 | Schwoebel et al. | |
| 6,267,539 | B1 | 7/2001 | Mihalcin | |

FOREIGN PATENT DOCUMENTS

| | | |
|---|---|---|
| GB | 1 461 162 A | 1/1977 |
| GB | 1 479 619 A | 7/1977 |
| WO | 92/07146 A | 4/1992 |

* cited by examiner

*Primary Examiner* — John Kreck
(74) *Attorney, Agent, or Firm* — The Webb Law Firm

(57) ABSTRACT

The present invention includes a hydro-shearing apparatus, a hydro-shearing system, and a method of mining waste coal. The hydro-shearing apparatus includes a fluid supply line adapted to permit the transporting of fluid, a nozzle adapted to emit the fluid, a pump adapted to recover at least the fluid, and a fluid discharge line adapted to permit the transporting of at least the fluid. The method may include positioning the hydro-shearing apparatus at least fifty feet away from a high wall of waste coal, manipulating the hydro-shearing apparatus to a vertical position within twenty feet of the top of the high wall of waste coal, operating the hydro-shearing apparatus such that a fluid stream contacts waste coal material, recovering the coal product with the pump of the hydro-shearing apparatus, and transporting the coal product away from the hydro-shearing apparatus.

13 Claims, 9 Drawing Sheets

COAL RECLAMATION APPARATUS AND METHOD

BACKGROUND OF THE INVENTION

Field of the Invention

The invention relates to processes for the recovery and treatment of coal materials and, more particularly, to processes for treatment of reclaimed waste coal.

Description of Related Art

Fine by-products of coal production and preparation have been generally disposed of into waste coal ponds. These waste coal deposits are potentially useful fuels. However, because they are presently stored in coal ponds they are generally useless in their current state.

Over time, private industry and the public sector have found that there may be benefits for which to remediate these waste coal ponds. One such benefit, for example, would be to remediate a waste coal pond in order to overcome a specific environmental and/or safety challenge created by the waste coal pond such as, for example, pond failure. Accordingly, solutions to accomplish these objectives have been suggested. It has not only become possible, but desirable to develop processes and equipment for the reclamation of land and fuel that were previously useless. Further, these reclamation projects and processes that have been developed have proved to be useful tools in obtaining beneficial fuels while accomplishing environmental goals encouraged and/or mandated by the presiding governmental authorities.

A waste coal pond may be mined via dredging and the recovered materials transported to a processing plant. One problem with dredging has been that the pond from which the materials are to be recovered must be flooded. Such flooding may destabilize a previously drained waste coal pond or create new seepage problems. Also, dredging normally produces a low density slurry containing insufficient coal solids such that more slurry volume must be obtained. Handling this higher volume of material is costly due to the addition of larger sumps, pumps, piping, etc., not to mention the additional downstream equipment necessary for separating out the unwanted materials recovered. Further, with dredging, the use of the same pond for disposal of tailings is prevented and ice formation is continually a problem during the winter months.

The drawbacks of mobile equipment mining are somewhat opposed to those of dredging. In particular, the waste coal ponds cannot be mined where they are soft or flooded. Further, hauling the mined material to the processing plant can prove expensive, particularly with the escalating prices of fossil fuels. In addition, vibration of the waste coal materials during transport tends to liquefy the entire mass. This results in making discharge of the waste coal material from the hauling vehicle very difficult and stockpiling of the waste coal material recovered nearly impossible.

Once the waste coal is harvested, it is first sorted and classified. A small portion of the waste coal may contain larger particulates of uncontaminated, or useful, coal that are then reclaimed immediately in the first step. However, smaller particulates are passed into a large multi-stage treatment process to reclaim finer particles of coal that may or may not have other sediments attached and coexist with contaminating mineral matter particles. Accordingly, the waste coal must be processed to separate it into its component parts in order to harvest the useful coal within the slurry.

In reclamation operations, problems unique to the size of waste coal materials obtained for these processes confound their purpose. For example, many of the separated finer particulates of waste coal exist in a clay-rich environment. This is a problem in that with decreasing particle size there is an exponential increase in the number of particles and subsequent surface onto which clay or other materials may attach and, therefore, cover the useful coal. In order to obtain useful coal from waste coal, these contaminates must be stripped from the useful coal so that a market-required BTU value and ash content can be achieved.

Numerous mechanical and chemical treatments must be performed in the processing plant to separate out the useful coal particulates from the remainder of the materials transported into the processing plant as waste coal. Due to contaminants surrounding the waste coal, excess water may be carried by these contaminants that adhere to the waste coal. Processes are generally known for the breaking up of the waste coal and contaminant agglomerates into their component parts by shearing and dispersion using large tanks with mechanical apparatuses and chemical additives to effectuate the necessary levels of separation. These processing methods and associated equipment have been developed to accomplish agglomerate dispersion once the waste coal has been harvested from the waste coal pond, although at a significant cost. More specifically, such processes can be time consuming and costly, requiring large energy costs, equipment costs, maintenance costs and chemical treatment costs, etc. However, currently these or similar costly agglomerate dispersion processes are necessary in order to facilitate the obtainment of useful coal products from the harvested waste coal which significantly increase labor and material costs associated with waste coal recovery operations.

SUMMARY OF THE INVENTION

The present invention includes a method of mining waste coal including the steps of employing a hydro-shearing apparatus. The hydro-shearing apparatus includes a frame, a fluid supply line supported by the frame and adapted to permit the transporting of fluid, a rotatable nozzle in communication with the fluid supply line adapted to emit the fluid away from the hydro-shearing apparatus toward waste coal, a pump supported by the frame for recovering the fluid and waste coal positioned below the rotatable nozzle, and a fluid discharge line supported by the frame and in communication with the pump, wherein the fluid discharge line is adapted to permit the transporting of the fluid and waste coal. The method also includes positioning the hydro-shearing apparatus at least fifty feet away from a high wall of waste coal at least twenty feet in height, manipulating the hydro-shearing apparatus to a vertical position within twenty feet of the top of the high wall of waste coal, operating the hydro-shearing apparatus such that a fluid stream contacts waste coal material such that the fluid and waste coal flow toward the hydro-shearing apparatus, recovering the fluid and waste coal with the pump of the hydro-shearing apparatus, and transporting the fluid and waste coal away from the hydro-shearing apparatus.

The present invention also includes a hydro-shearing apparatus comprising, a frame, a fluid supply line supported by the frame and adapted to permit the transporting of fluid, a rotatable nozzle supported by the frame and in communication with the fluid supply line, wherein the rotatable nozzle is adapted to emit the fluid away from the hydro-shearing apparatus, a pump supported by the frame and adapted to recover at least the fluid emitted from the rotatable nozzle, a fluid discharge line in communication with the pump and supported by the frame, wherein the fluid discharge line is adapted to permit the transporting of at least the fluid, and a nozzle extension supported by the rotatable nozzle and in communication with the rotatable nozzle, wherein the nozzle extension is adapted to redirect the fluid as it is emitted from the rotatable nozzle.

The present invention further includes a hydro-shearing system comprising a mounting apparatus supporting a hydro-shearing apparatus and a transport vehicle having the mounting apparatus attached thereto, wherein the transport vehicle is adapted to reposition the hydro-shearing apparatus. The hydro-shearing apparatus includes a frame having a pair of connectors extending away from the hydro-shearing apparatus, a fluid supply line supported by the frame and adapted to permit the transporting of fluid, a rotatable nozzle supported by the frame and in communication with the fluid supply line, wherein the rotatable nozzle is adapted to emit the fluid away from the hydro-shearing apparatus, a pump supported by the frame and adapted to recover at least the fluid emitted from the rotatable nozzle, a fluid discharge line in communication with the pump and supported by the frame, wherein the fluid discharge line is adapted to permit the transporting of at least the fluid. The mounting apparatus further includes support members removably attaching the mounting apparatus with the frame of the hydro-shearing apparatus, control cables connected to the connectors of the hydro-shearing apparatus and adapted to position the hydro-shearing apparatus about a substantially vertical axis, and an actuator adapted to reposition the control cables.

DESCRIPTION OF THE PREFERRED EMBODIMENT(S)

This invention now will be described more fully hereinafter with reference to the accompanying drawings, in which exemplary embodiments are shown. The invention may, however, be embodied in different forms and should not be construed as limited to the embodiments set forth herein; rather, these embodiments are provided so that this disclosure will be thorough and complete, and will fully convey the scope of the invention to those of ordinary skill in the art. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure). Thus, for example, it will be appreciated by those skilled in the art that the schematics and the like represent conceptual views of illustrative structures embodying this invention.

In order to carry out a reclamation operation of waste coal materials 500, the waste coal material 500 may be prepared, treated and/or repulped utilizing a hydro-shear system 10 to condition the waste coal material 500 and convert it into a useable form. Such reclamation, utilizing the hydro-shear system 10 as illustrated in FIGS. 1-7, requires minimal labor and maintenance and provides access to areas otherwise inaccessible with conventional mining machinery or techniques such as, for example, dredging or dry mining. Further, according to the present invention, the process for reclamation described below may reduce steps and make more efficient utilization of equipment when compared to that of known prior art processes required for mining, shearing and dispersion.

The waste coal materials 500 generally maintain a stratified and/or consolidated composition before treatment with the hydro-shear system 10. In attempting to recover such waste coal material 500, attempts to dredge the waste coal material 500 proved to be about half as effective when compared with the use of the hydro-shear system 10. As will be described in greater detail below, proper treatment of the waste coal 500 with the hydro-shear system 10 not only produces suitable slurry for transportation, but further accomplishes beneficial shearing and dispersion to facilitate subsequent beneficiation and dewatering, provided the appropriate methods described herein are implemented.

Figure 1A:
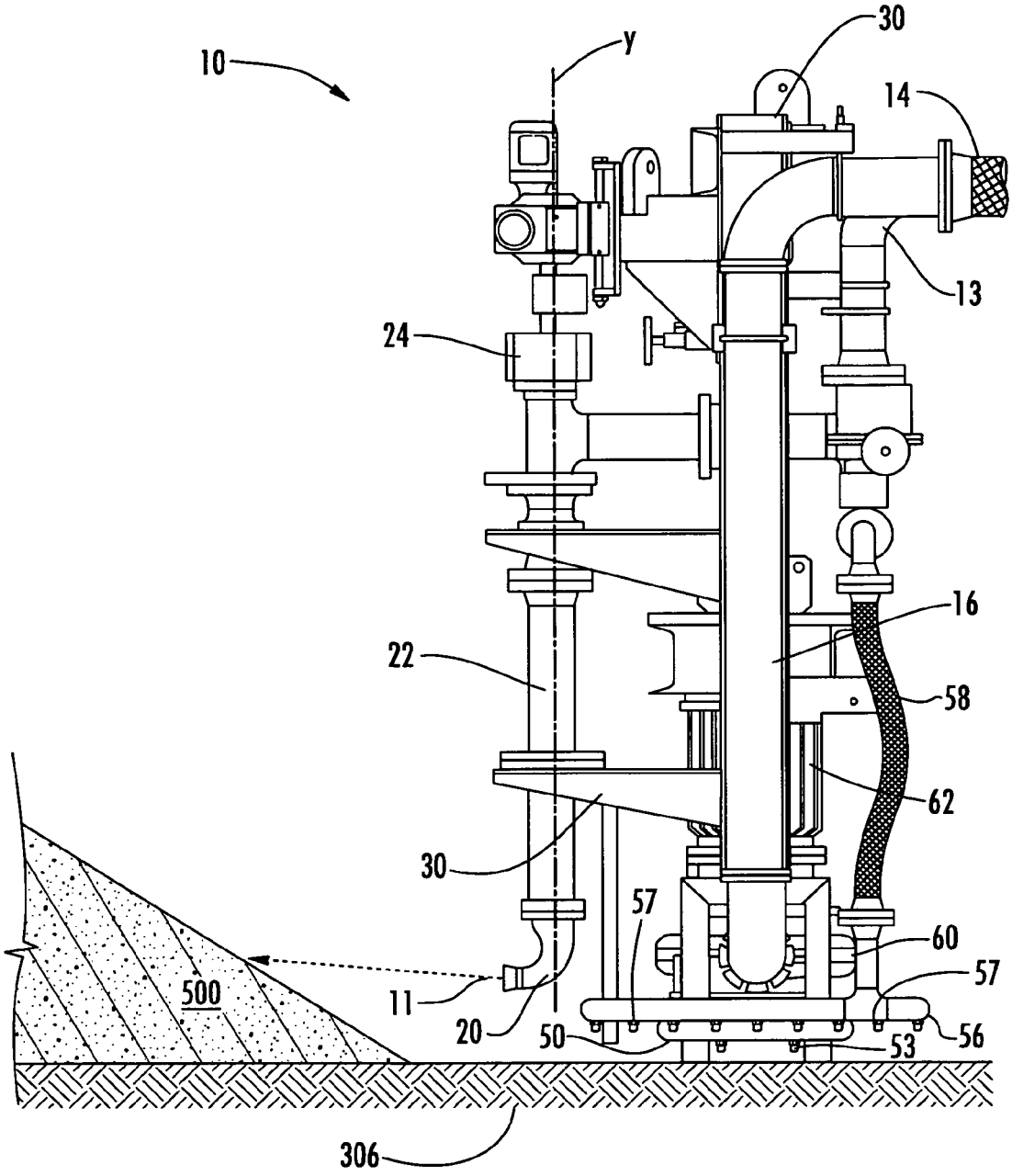
FIG. 1*a* is a side view of an embodiment of a hydro-shear system as it may be employed according to the present invention.
Figure 1B:
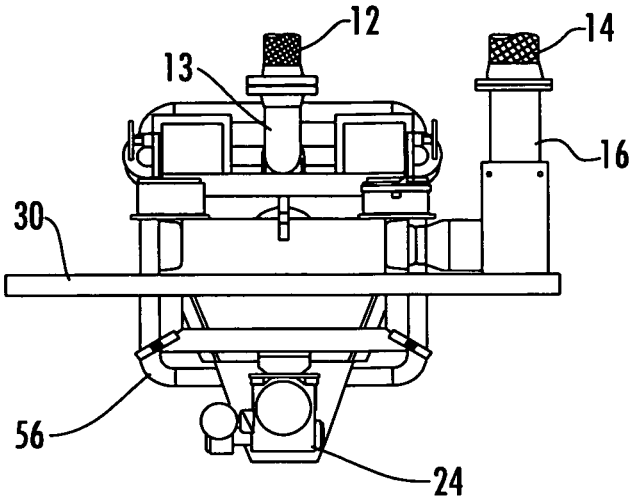
FIG. 1*b* is a top plan view of the hydro-shear system of FIG. 1*a;*
Figure 1C:
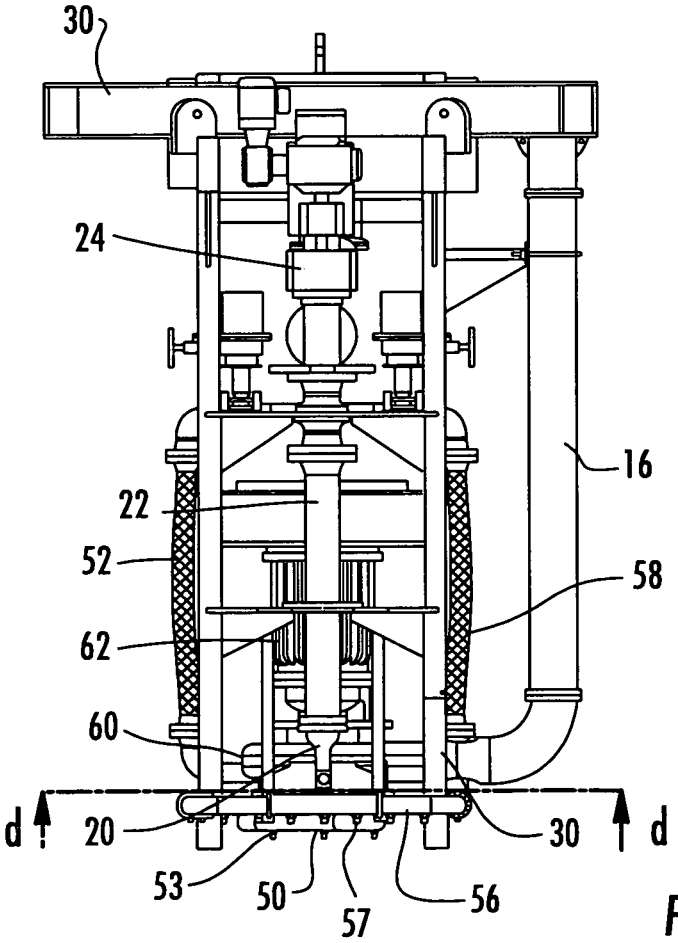
FIG. 1*c* is a front view of the hydro-shear system of FIG. 1*a;*
Figure 8:
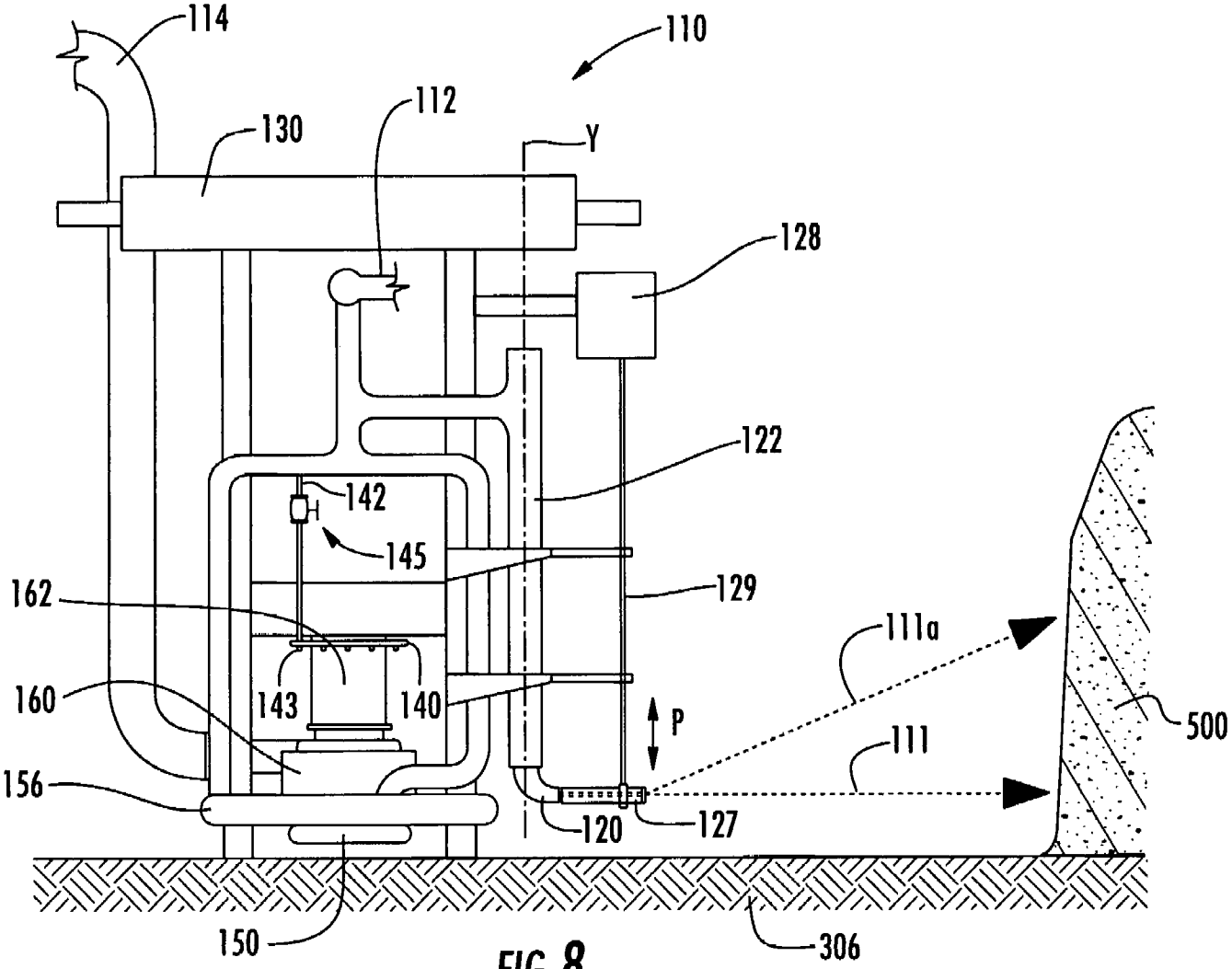
FIG. 8 is a side view of an embodiment of a hydro-shear system as it may be employed according to the present invention.

More specifically, the hydro-shear system 10 generates a concentrated high-intensity fluid stream 11 that is directed toward stratified and/or consolidated waste coal material 500 as shown in FIG. 1*a*. Accordingly, as shown in FIGS. 1*a*, 1*c*, and 8, the hydro-shear system 10 is equipped with a static nozzle 20 supported on a frame 30. The static nozzle 20 may be supplied with high-pressure water from a pump or other source (not shown), or other desired fluid, through a fluid supply line 12 and into a chamber 22 connected to, and in communication with, the fluid supply line 12. Pressures supplied through the chamber 22, and any pressure boosters that may be implemented therewith, may emit the high-intensity fluid stream 11 at velocities in excess of 10,000 feet/min.

The static nozzle 20 may also be rotatably positionable by way of an oscillation mechanism 24 in communication with the static nozzle 20. Such horizontal rotation may be limited due to physical limitations of the hydro-shear system 10 and its mounting configuration. Accordingly, oscillation mechanism 24 may provide approximately two hundred ten degrees (210°) of rotation or less about a vertical axis Y. Thus, the concentrated high-intensity fluid stream 11 ejected from the static nozzle 20 may be generally directed toward the waste coal 500 in a desired manner, within the limited range of motion provided to achieve certain results in accordance with the present invention.

Figure 2:
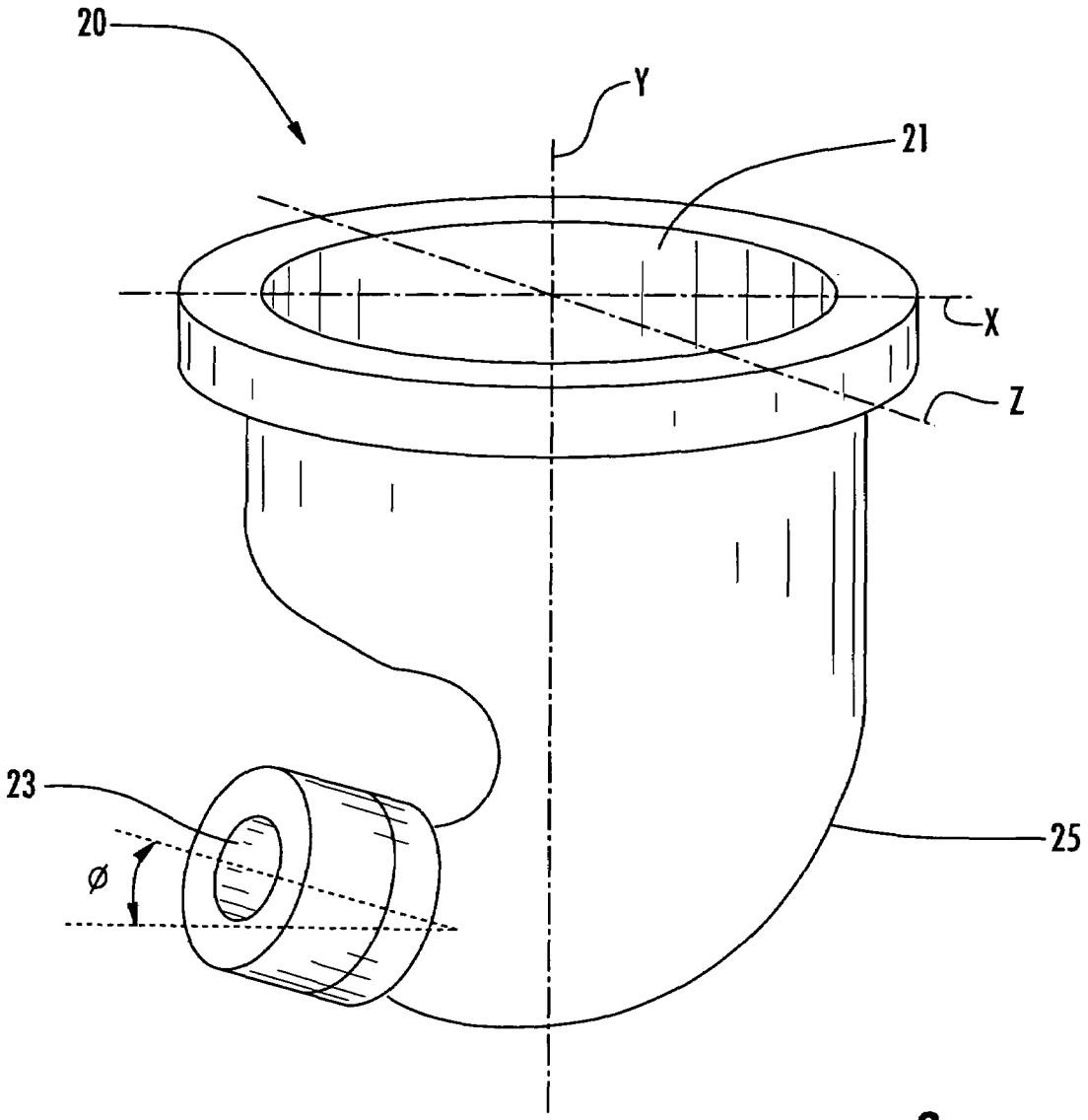
FIG. 2 is a perspective view of an embodiment of a nozzle of the hydro-shear system shown in FIG. 1*a;*

The static nozzle 20 is shown in detail in FIG. 2. The static nozzle 20 has an inlet 21 and an outlet 23. The inlet to the static nozzle 20 is illustrated as generally concentric about the Y axis in the X-Z plane, although other useful configurations may be implemented for a desired flow through outlet 23. Between the inlet 21 and the outlet 23, the fluid stream is pushed through the static nozzle 20 is turned from a downward flow direction to a generally horizontal direction. As the fluid stream enters the inlet 21, the velocity of the fluid stream is lower than at the outlet 23 due to a narrowing channel through which the fluid stream will flow. Accordingly, a high pressure fluid stream 11 is created upon the exit of the fluid stream through the outlet 23. This is accomplished, while maintaining the intensity of the fluid stream 11, by the gooseneck curvature 25, having a narrowing internal diameter from inlet 21 to outlet 23 that prevents turbulence within the static nozzle 20 and preserves the integrity of the fluid stream through static nozzle 20. The outlet 23 of the static nozzle 20 may also be slightly inclined at an angle Ø, which may range from zero to five degrees generally above horizontal.

Once the hydro-shear system 10 is operational and the static nozzle 20 is functioning to create a desired flow of waste coal material 500, now in slurry form, back toward the hydro-shear system 10, a slurry pump 60 is activated. The slurry pump 60 has an intake 51 positioned on a lower portion of the hydro-shear system 10. The slurry pump 60 is supported on the frame 30, wherein the intake 51 is positioned below the static nozzle 20. The slurry pump 60 is thus provided to direct the flow of reclaimed slurry upward into the hydro-shear system 10 such that the reclaimed slurry may be transported to the processing plant through a slurry discharge line 14. Accordingly, the hydro-shear system 10 is equipped with at least one slurry pump 60 to pressurize the flow of reclaimed waste coal material 500 in slurry form back toward the processing plant through the slurry discharge line 14 for further handling.

The intake 51 may also be provided with a screen guard cover (not shown) to prevent oversized particles from entering the intake 51 and possibly inhibiting the removal of waste coal material 500. Such a screen guard cover may be removably or permanently attached to the bottom of the hydro-shear system 10 in various known manners such that oversized particles, as determined by the physical limitations of the slurry pump 60 and slurry discharge line 14, may be prevented from entering the intake 51 of the slurry pump 60.

The hydro-shear system 10 may also incorporate a sink ring 56 positioned at a lower portion of the hydro-shear system 10. The sink ring 56 may facilitate the penetration of the hydro-shear system 10 into the waste coal material 500 to be recovered. Accordingly, the sink ring 56 may be provided with nozzles 57 for directing fluids generally in a downward direction to hydraulically dislodge and repulp waste coal material 500 beneath the hydro-shear system 10. Thus, as fluid is directed downward by the sink ring 56 and then reacquired through the intake 51 of the slurry pump 60, the hydro-shear system 10 will penetrate the waste coal material 500 below the hydro-shear system 10. In addition, the hydro-shear system 10 may be further provided with controls for regulating the amount of fluid directed downward for accelerated descent into the waste coal material 500 if so desired by the operator of the hydro-shear system 10, depending upon the characteristics of the material.

Figure 1D:
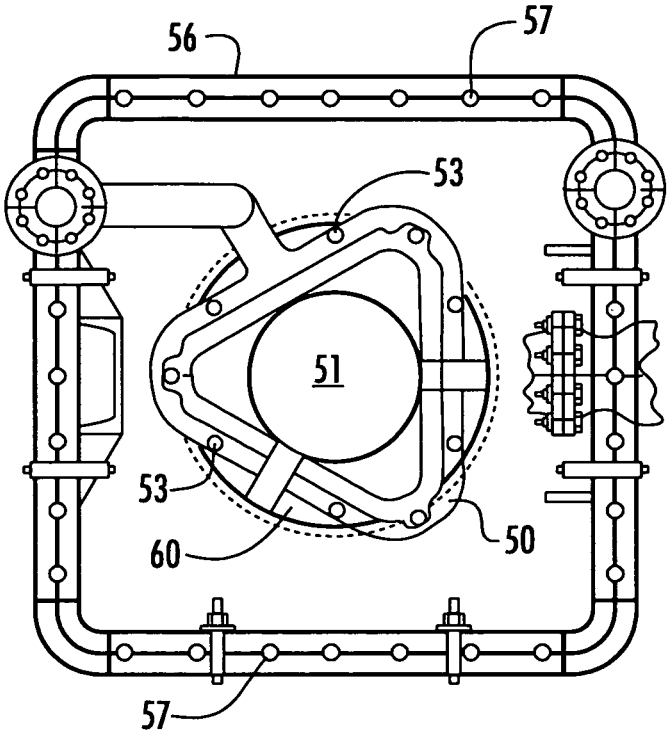
FIG. 1*d* is a bottom view of the hydro-shear system of FIG. 1*c* as viewed toward a cross-section taken at line d-d in FIG. 1*c;*

As shown in FIGS. 1*a*, 1*c* and 1*d*, an eductor ring 50 may be provided near the lower portion of the hydro-shear system 10 for directing fluids received from the fluid supply pipe 13 downward. Although FIG. 1*d* shows the eductor ring 50 configured in a triangular shape, other configurations of the eductor ring 50 may be implemented in accordance with the present invention. Accordingly, the eductor ring 50 may be positioned below the intake 51 of the slurry pump 60 and may be provided with nozzles 53 for directing fluids downward away from the intake 51 of the slurry pump 60. The eductor ring 50 may thus facilitate the hydraulic deagglomeration of waste coal material 500 that may enter the hydro-shear system 10 through the intake 51 of the slurry pump 60. Further, where high solids content of the waste coal material 500 is present, the eductor ring 50 may also be used to further fluidize the repulped waste coal material 500 beneath the intake 51 of the slurry pump 60. In addition, the hydro-shear system 10 may be further provided with controls for regulating the amount of fluid directed downward if so desired by the operator of the hydro-shear system 10, depending upon the characteristics of the waste coal material 500 entering the intake 51 of the slurry pump 60.

Figure 1E:
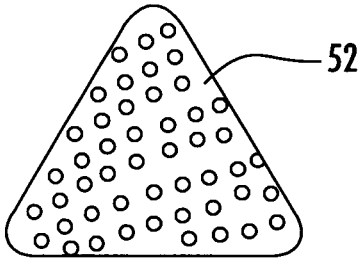
FIG. 1*e* is a plan view of an embodiment of a screen in accordance with the present invention.
Figure 1F:
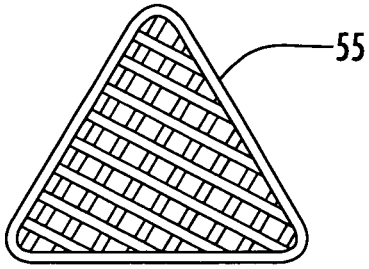
FIG. 1*f* is a plan view of an embodiment of a screen in accordance with the present invention.

The eductor ring 50 may also be provided with at least one screen guard cover 52, 55, which is illustrated in FIGS. 1*e* and 1*f*, to prevent oversized particles from entering the intake 51 of the slurry pump 60. These oversized particles could inhibit the removal of waste coal material 500 through intake 51 and varying site conditions could determine which size and/or type of screen guard cover 52, 55 is employed. Any such screen guard cover 52, 55 may be removably or permanently attached directly to the eductor ring 50 or the bottom of the hydro-shear system 10 in various manners such as wire, clamps, etc. In one embodiment, a screen 52 comprising a plate with holes positioned therethrough could be removably affixed to the bottom of the eductor ring 50 covering an area inside the nozzles 53 so as to not inhibit the release of fluid through nozzles 53. In another embodiment, a screen 55 may be formed of crossing and/or meshing rebar and welding the same together to cover intake 51 that could be removably attached to the eductor ring 50. Regardless of how the screen guard cover 52, 55 is mounted, via wire, fasteners, etc., it preferably should surround the eductor ring 50 and intake 51 such that oversized particles, as determined by the physical limitations of the slurry pump 60 and slurry discharge line 14, may be prevented from entering the intake 51 of the slurry pump 60.

The mounting and gross height adjustment of the hydro-shear system 10 may be regulated by various arrangements as discussed in further detail below and shown in FIGS. 3-6.

Generally, in order to begin the waste coal material 500 reclamation process according to the present invention, the hydro-shear system 10 must be positioned properly on some form of mounting arrangement as illustrated in FIGS. 3-6. For instance, the hydro-shear system 10 may be mounted on a platform 70, or a crane 72. One embodiment of the present invention further implements an excavator 80 for mounting and controlling the hydro-shear system 10 to effectively facilitate the treatment and reclamation of the waste coal materials 500. Other mounting arrangements are envisioned within the scope of the present invention, although only three specific examples are described in detail herein.

Figure 3:
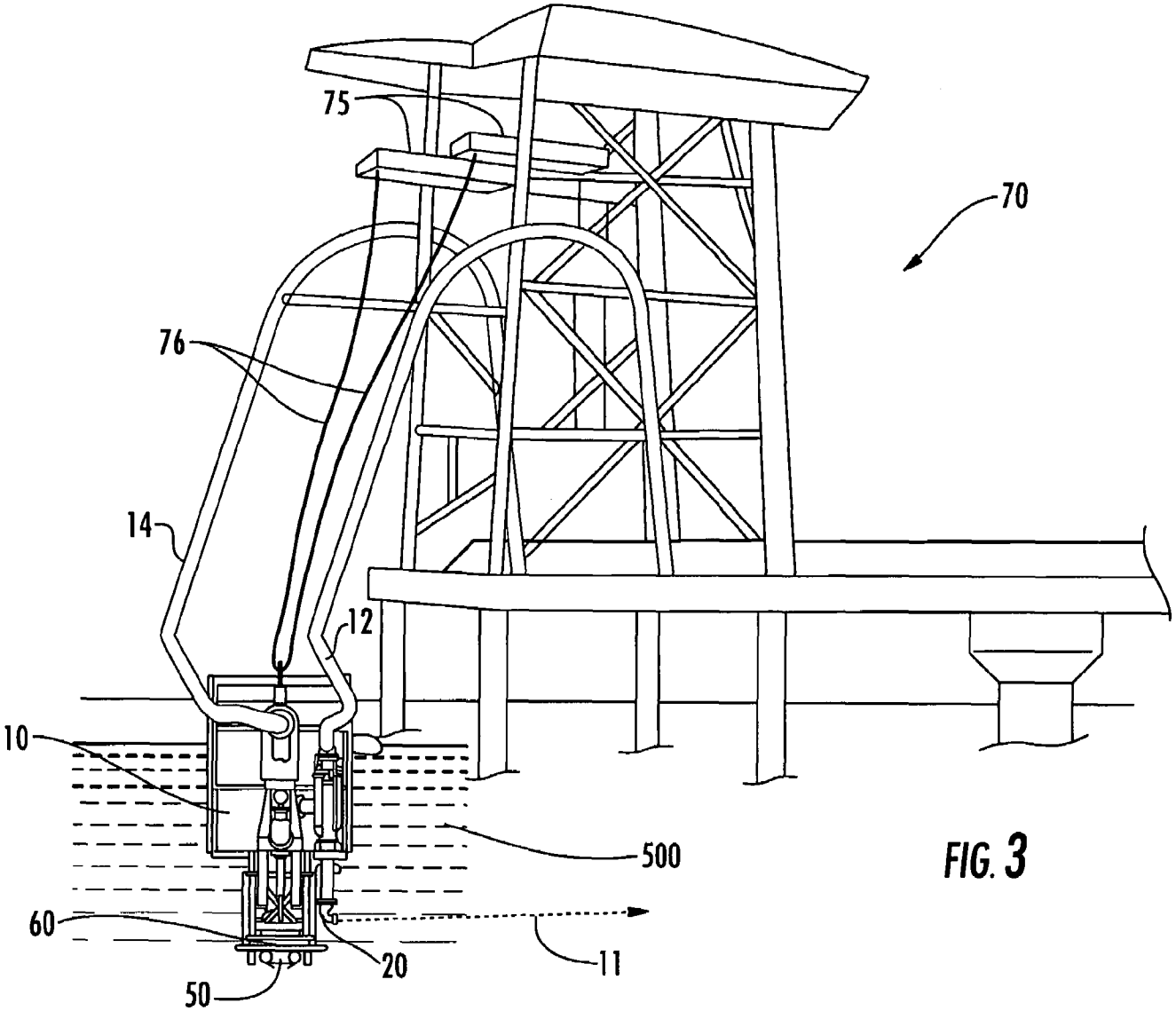
FIG. 3 illustrates an embodiment for employing the hydro-shear system in accordance with the present invention.

As can be seen in FIG. 3, the platform 70 may be employed to mount the hydro-shear system 10. The hydro-shear system 10 arrangement with the platform 70 may incorporate support members 76 from which the hydro-shear system 10 may be hung. Although support members 76 are shown as cables, alternative control members are envisioned as being within the scope of such as, for example, chains, ropes, etc. Further, a boom apparatus 75, which is permanently affixed to the platform 70 may also be incorporated to connect to the support members 76. The boom apparatus 75 may allow for the repositioning of the hydro-shear system 10 in a very limited manner. Regardless, some applications of employing the hydro-shear system 10 may be entirely accomplished using the platform 70 configuration to reclaim waste coal materials 500 as shown in FIG. 3.

As can be seen in FIG. 3, the fluid supply line 12 is connected to the hydro-shear system 10. The supply line 12 provides the medium for which the static nozzle 20 will eject the high pressure fluid stream 11 toward the waste coal material 500 in the making of suitable reclaimed slurry. The slurry discharge line 14 is also illustrated in FIG. 3 and is in communication with the slurry pump 60 of the hydro-shear system 10. Accordingly, the waste coal material 500 in slurry form is recovered by the slurry pump 60 and transferred through the slurry discharge line 14 to the processing plant.

Depending upon the waste coal pond characteristics, various challenges are presented that may require varying equipment and mounting arrangements. Accordingly, other mobile configurations for mounting the hydro-shear system 10 may be incorporated. These other attachments may include, for example, a crane 72 or other movable support capable of being maneuvered to differing locations within the waste coal slurry pond vicinity.

Figure 4:
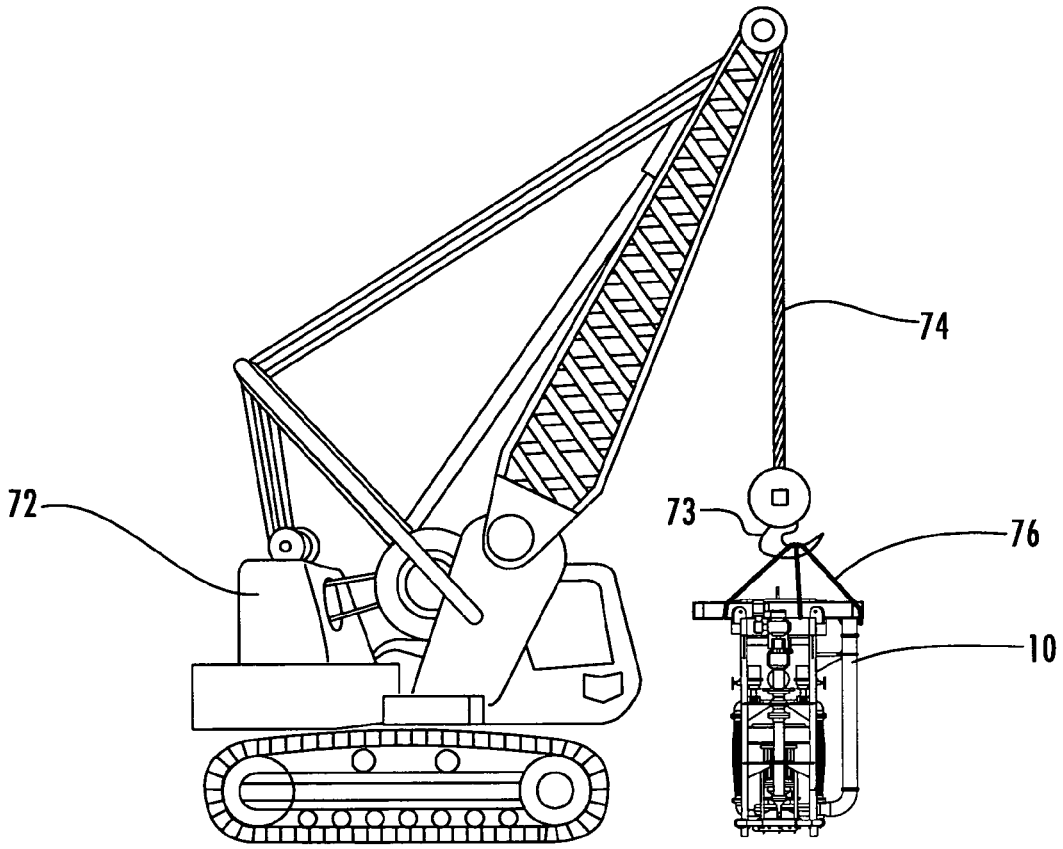
FIG. 4 illustrates an embodiment for employing the hydro-shear system in accordance with the present invention.

As can be seen in FIG. 4, mobile equipment may be required for the given application such as through the employment of crane 72. Crane 72 may be employed to suspend the hydro-shear system 10 by support members 76. Although support members 76 are shown as cables, alternative support members are envisioned as being within the scope of the invention such as, for example, chains, ropes, etc. In this mounting arrangement, three support members 76 may be attached to the frame 30 of the hydro-shear system 10 to support the hydro-shear system 10 at varying heights. The three support members 76 may also be then connected to a connector 73 attached to the crane 72 via cable 74 to support the hydro-shear system 10. Connector 73 is illustrated as a hook in FIG. 4, although other configurations are contemplated as is known in the art. As the crane 72 is articulated, so the hydro-shear system 10 may be directed to those portions of the waste coal material 500. The mobility of the crane 72 may also prove beneficial in the safety and effective operation of the hydro-shear system 10. However, due to the connector 73 also being suspended from cable 74, the hydro-shear system 10 is limited in its positioning for directing the hydro-shear system 10 due to the limited capability as the hydro-shear system 10 is hanging from and subject to motion from the cable 74. In addition, it may prove difficult to adequately adjust the horizontal direction of the fluid jet 11 the of the hydro-shear system 10 where the crane 72 is positioned on uneven terrain.

Figure 5:
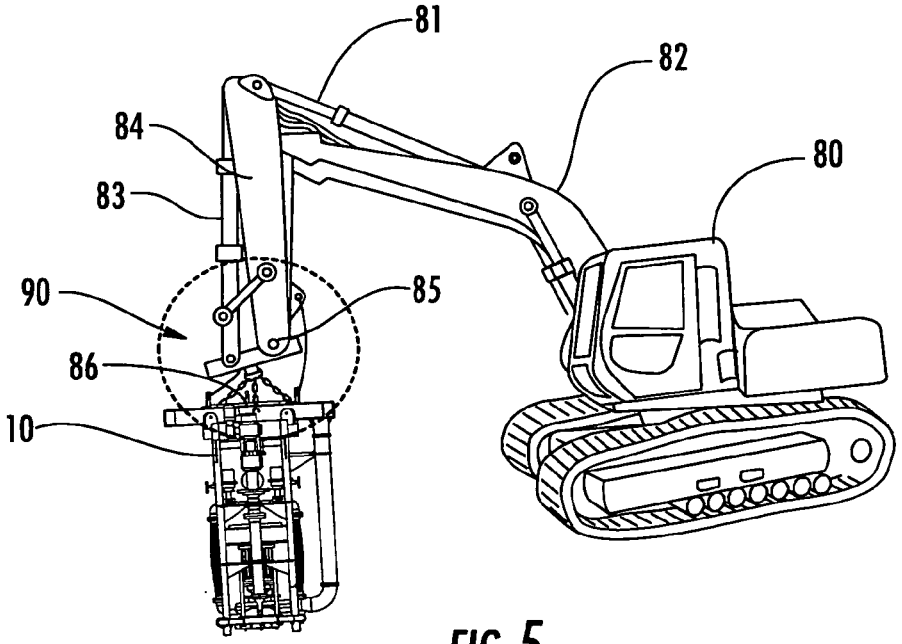
FIG. 5 illustrates an embodiment for employing the hydro-shear system in accordance with the present invention.
Figure 6:
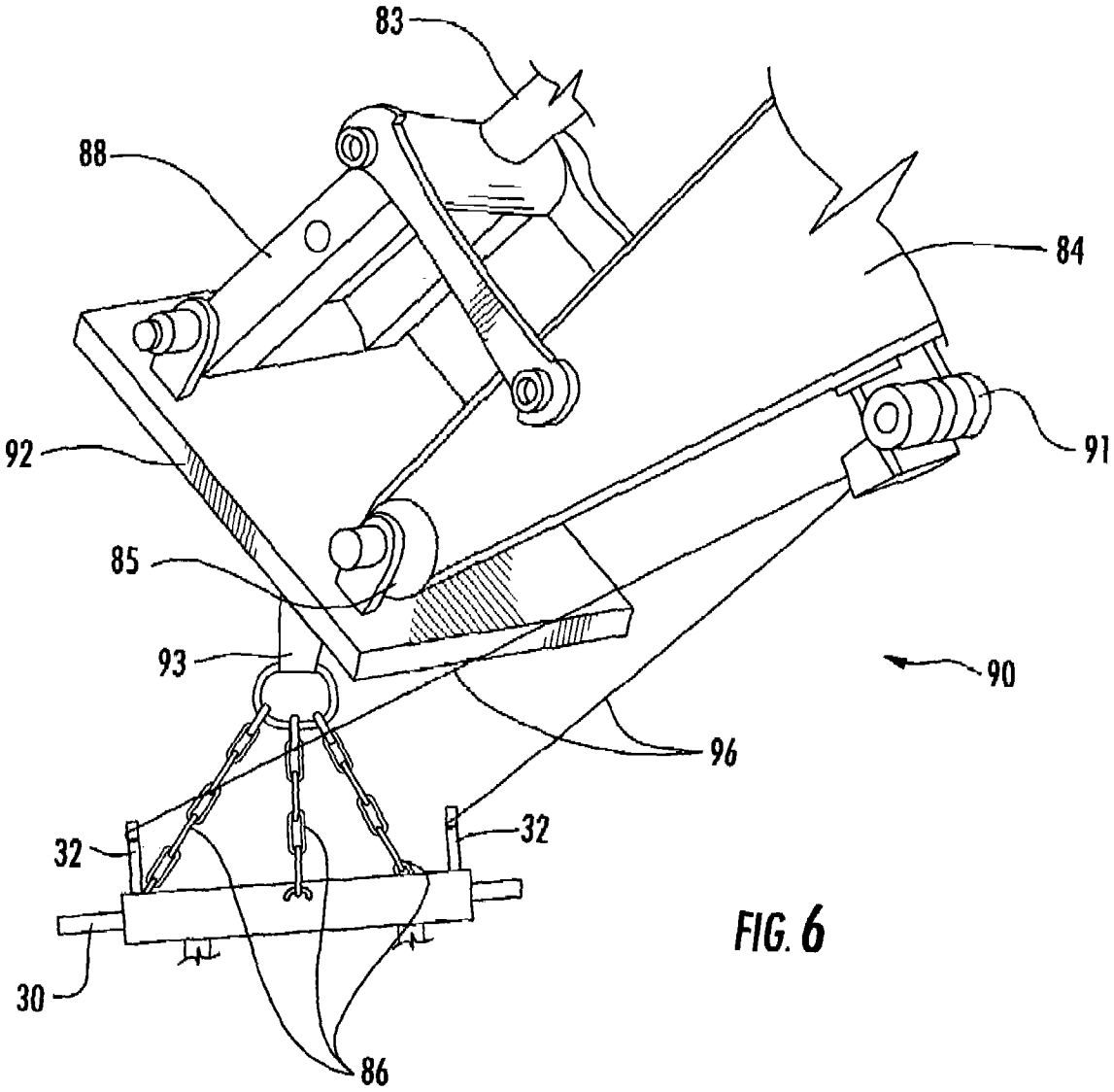
FIG. 6 is an enlarged view in section of an embodiment of a mounting apparatus shown in dashed-lines in FIG. 5.

Another embodiment of the present invention incorporates an excavator 80 and a mounting apparatus 90 therefor, as illustrated in FIGS. 5 and 6. The excavator 80 is another mobile application having greater positioning capabilities of hydro-shearing system 10 due to the configuration of mounting apparatus 90. In addition, due to the proximity of the hydro-shear system 10 to the mounting apparatus 90, positioning of the hydro-shearing system 10 is less effected by swaying with the hydro-shearing system 10 supported to the excavator 80 by support members 86 in close proximity to the mounting apparatus 90. Although support members 86 are shown in the drawings as chains, alternative supports are envisioned as being within the scope of the invention such as, for example, cables, ropes, etc. The excavator 80 may have a boom 82 attached to an arm 84. The boom 82 and arm 84 may be articulated via various actuators 81, 83, which may be, for example, hydraulic or otherwise powered as is known in the art. Further, mounting apparatus 90 may be mounted to a linkage 88 positioned near an end 85 of the arm 84 along with being attached to the end 85 of the arm 84. As can be seen in detail in FIG. 6, the linkage 88 may be attached to the arm 84 and further articulated by second actuator 83. The arm 84 may be articulated by first actuator 81. Accordingly, the hydro-shear system 10 may be positioned in such a way so as to enable the hydro-shear system 10 to be positioned in an orientation for directing fluid jet 11 that would otherwise be inaccessible with other mounting means.

As can be seen in FIG. 6, the mounting apparatus 90 has a plate-like portion 92 that is mounted to the linkage 88 and arm 84 of the excavator 80. The mounting arrangement between the mounting apparatus 90 and the excavator 80 may be pivotal in nature to allow the maximum functionality of positioning the hydro-shear system 10. Further, depending from the plate-like portion 92 is the connector 93 which may be connected to the support members 86. Accordingly, the frame 30 of the hydro-shear system 10 may then be connected to the excavator 80 via support members 86.

In order to accurately position the hydro-shear system 10 and provide an enlarged range and more precise targeting of the high pressure fluid stream 11, the mounting apparatus 90 may further incorporate an actuator 91, control cables 96 and connectors 32. The actuator 91 may be an electronic winch or other actuator capable of controlling the control cables 96, which may be attached to connectors 32 of the frame 30. Connectors 32 may take the form of poles, as illustrated in FIG. 6 or may otherwise be hooks, rings, etc. as is contemplated by the present invention. Accordingly, by manipulating the control cables 96, the hydro-shear system 10 may be provided with further means for adjusting the positioning of the hydro-shear system 10 about a generally vertical axis for directing the high pressure fluid stream 11 toward a desired target of the waste coal material 500 without requiring movement of the entire excavator 80.

Not only must the hydro-shear system 10 be properly mounted, it must also be positioned in a pre-determined location in the waste coal pond to achieve optimal results and to prevent any hazards resulting from working in such environments. Accordingly, the method of removal is dependent upon the characteristics of the waste coal pond. Most waste coal slurry ponds are unique in their composition and geographical dimensions. However, many waste coal ponds are formed naturally using the topography of the surrounding land in which the waste coal was pumped into. Accordingly, it is not uncommon for the waste coal to build up over time into ponds ranging from 10-100 feet in depth or greater.

Adjustability and portability of the hydro-shear system 10 enables adequate mobility necessary to complete reclamation projects effectively and without unnecessary hazard. One hazard to be avoided is the possibility of removing too large of a section of the supporting bottom layers of waste coal. Where the hydro-shear system 10 has worked to a depth such that large walls are formed surrounding the hydro-shear system 10, such a hazard may occur endangering the safety of those involved in the reclamation project.

While positioned below a high wall 300 of waste coal material 500, hazards may be present where the static nozzle 20 causes excess removal of waste coal material 500. Removing the bottom layers of waste coal 500 by undercutting the high wall 300 may adversely effect the stability of the waste coal 500 positioned above that portion of waste coal 500 to which the high pressure fluid jet 11 is applied. The vertical compressive force exerted by upper layers 302 of waste coal 500 will, at some point depending upon the characteristics and consolidated strength of the waste coal 500, overcome the now depleted support. This may result in a landslide of waste coal material 500 of unpredictable magnitude. Such an occurrence may result in damage to the equipment and/or injury to operating personnel. Accordingly, it has been shown to produce more effective results and prevent unnecessary hazard where the hydro-shear system 10 is positioned at least fifty feet from the high wall 300 and the operator is positioned another twenty-five feet behind and twenty feet above the hydro-shear system 10.

Figure 7:
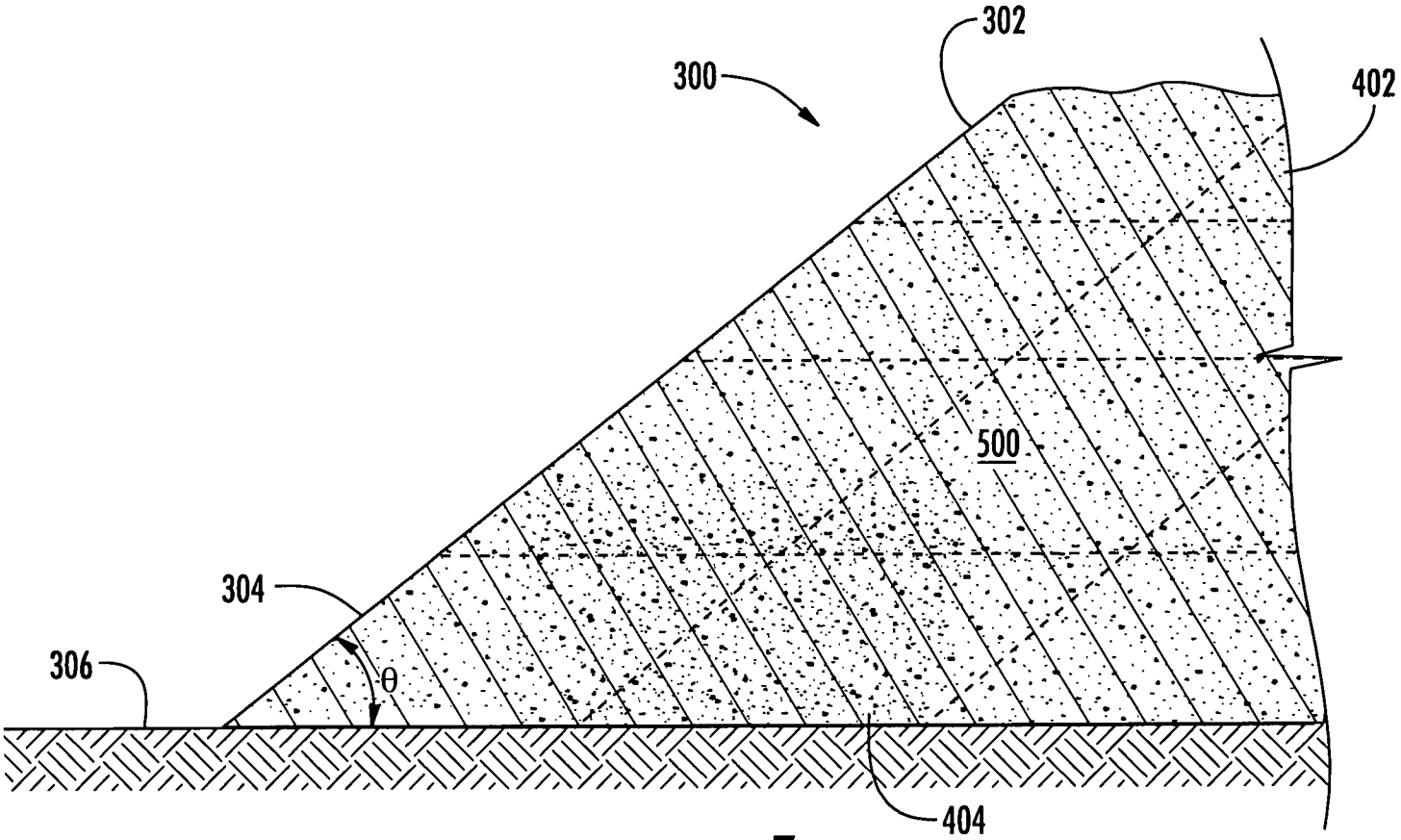
FIG. 7 illustrates a cross-sectional view of an embodiment of layers in a waste coal pond.

In employing the hydro-shear system 10, the preferred method for removal effectively removes waste coal material 500 to accomplish effective treatment. As can be seen in FIG. 7, the consolidated waste coal material 500 to be removed may exist as a self-supporting high wall 300, having a base 306, that will be harvested through methodically descending through layers of waste coal material 500. The waste coal material 500 generally forms a natural angle of repose θ that is stable when maintained at the natural θ or less. Generally, the natural angle of repose θ is determined by the in-situ characteristics of the waste coal material 500 and thus is site specific. However, in practice, the angle θ has been determined using standard laboratory tests and may be found to be, for example, thirty-five degrees. Accordingly, the first cut of material with the hydro-shear system 10 would proceed generally from top to bottom of the high wall 300 directing the high pressure fluid jet 11 to contour the top layer 302 of material 500 to a thirty-five degree slope. The vertical height of each layer of waste coal material 500 that is removed from top to bottom may be twenty feet or less. However, in practice, the precise height of layer removal will be determined by the site specific requirements and judgment of the operator of the hydro-shear system 10. As the method is carried out, repetitive layers of waste coal material 500 will be removed effectively treating the waste coal material 500 for further processing in the plant. When the bottom layer 304 is finally removed, exposing the base 306, the entire face of the high wall 300 should maintain the determined profile angle θ, for example, thirty-five degrees. The hydro-shear system 10 may accordingly be repositioned forward approximately thirty feet or so as determined by the particular prior removal characteristics. Thus, the top layer 402 of the next profile of waste coal material 500 would be removed working toward the bottom layer 404 of that profile.

A preferred method of waste coal material 500 removal includes loosening the consolidated in-situ waste coal material 500 using water, air, or a combination thereof. Accordingly, in loosing such waste coal material 500 from the top layer 302 down, the waste coal material 500 may fall in a controlled manner at the natural angle of repose θ, or less, toward the hydro-shear system 10. Alternatively, mobile equipment may be used to loosen, break-up or push material on a slope downward toward the hydro-shear system 10 provided the stability of the waste coal material 500 not loosened would support such equipment without unnecessary hazard.

Another embodiment of the method of removal may include loading consolidated waste coal material 500 from remote sections of the waste pond using excavating equipment and mobile haulers. The waste coal material 500 removed in this manner may then be transported to the vicinity of the hydro-shear system 10 and dumped as unconsolidated waste coal material 500 within or near the range of the high pressure fluid jet 11. Presentation of loosened waste coal material 500 to the hydro-shear system 10 may relieve the high pressure fluid jet 11 from some of the energy used on waste coal material 500 deconsolidation. Thus, more energy from the hydro-shear system 10 may be effectively used for dispersion of the waste coal material 500 into its component parts of fine solids. In addition, higher solids content of the waste coal materials 500 is generally attainable.

Accordingly, by employing the method of removal of waste coal material 500 of the present invention, the shearing, dispersion and deagglomeration of the waste coal 500 without mechanical mixing or chemical treatment is accomplished through processing the waste coal 500 with the hydro-shear system 10. Accordingly, the waste coal material 500 is converted into useful coal through the application of high shear forces that break down the adhesion and attractive forces which bond clay particles to the waste coal material 500. The hydro-shear system 10 thus treats the clay particles and deagglomeration occurs which renders the individual coal impurities, other than clay, and clay particles into a state of discreteness. The individual clay particles become discrete and become suspended as a colloid in the associated fluid of the liquid medium, generally high pressure water. Under these conditions, the individual coal particles attain a state of discreteness from clay and other coal impurities released from the face surfaces of the waste coal 500. Once free of adhered clay, the coal particles are rendered more fully hydrophobic, and thus treated for further processing.

As can be seen in FIG. 8, an embodiment of a hydro-shear system 110 is shown in accordance with the present invention. Hydro-shear system 110 generates a concentrated high-intensity fluid stream 111 that may also be directed toward stratified and/or consolidated waste coal material 500. The hydro-shear system 110 is equipped with a static nozzle 120 supported on a frame 130, having a flexible extension 127. The static nozzle 120 may be supplied with high-pressure water from a pump or other source (not shown), or other desired fluid, through a fluid supply line 112. A chamber 122 may be connected to, and in communication with, the fluid supply line 112 for supplying the fluid. Pressures supplied through the chamber 122, and any pressure boosters that may be implemented therewith, may emit the high-intensity fluid stream 111 at velocities in excess of 10,000 feet/min or otherwise as is determined by the in-situ characteristics of the waste coal pond.

Although, static nozzle 120 and flexible extension 127 may be rotatably positionable by way of an oscillation mechanism (not shown) in communication with the static nozzle 120, such horizontal rotation may be limited due to physical limitations of the hydro-shear system 110 and its mounting configuration on frame 130. Accordingly, the mounting apparatus 90 may provide additional rotation if necessary and incorporated with hydro-shear system 110. Vertical adjustability may be provided through implementation of actuator 128 in combination with the flexible nozzle extension 127. Actuator 128 may be attached to the frame 130 and thus be connected to flexible nozzle extension 127 via link 129 and may further be employed to vertically position P the flexible nozzle 127 to adjust the direction of the fluid stream 111 to an elevated fluid stream 111*a*. Thus, the concentrated high-intensity fluid stream 111 ejected from the static nozzle 120 may be provided a greater vertical range of directing the fluid stream 111 toward the waste coal 500 in a desired manner. Accordingly, the hydro-shear system 110 may achieve a wider range of results in accordance with the present invention.

A slurry pump 160 is also provided, having a pump motor 162, to direct the flow of reclaimed slurry upward into the hydro-shear system 110 such that the reclaimed slurry may be transported to the processing plant through a slurry discharge line 114. Accordingly, the hydro-shear system 110 is equipped with at least one slurry pump 160 to pressurize the flow of reclaimed waste coal material 500 in slurry form back toward the processing plant through the discharge line 114 for further handling.

Generally, slurry pump 160 is provided as a submersible pump such that the hydro-shear system 110 can be used in a submersed or semi-submersed state. Where the hydro-shear system is not sufficiently submersed, the slurry pump 160 may tend to overheat in certain environmental conditions. Thus, the hydro-shear system 110 may further be provided with a cooling mechanism 140 that may be adapted to prevent overheating of the pump motor 162. The cooling mechanism 140 may be in communication with the fluid supply line 112, through cooling line 142, for supplying the fluid that may cool the pump motor 162. Further, flow of cooling fluids may be controlled by cooling valve 145 as shown in FIG. 8. In order to direct the fluids from fluid supply line 112 onto the pump motor 162, nozzles 143 may be provided on the cooling mechanism to direct fluid in a desired manner to accomplish the requisite cooling effect.

While the present invention was described by way of a detailed description of several embodiments of a hydro-shear system and mounting apparatuses therefor, those skilled in the art may make modifications and alterations to this invention without departing from the scope and spirit of the invention. Accordingly, the foregoing description is intended to be illustrative rather than restrictive. The invention described hereinabove is defined by the appended claims, and all changes to the invention that fall within the meaning and the range of equivalency of the claims are to be embraced within their scope.

The invention claimed is:

1. A hydro-shearing apparatus comprising:

a frame;

a fluid supply line supported by the frame and adapted to permit the transporting of fluid;

a rotatable nozzle supported by the frame and in communication with the fluid supply line, wherein the rotatable nozzle is adapted to emit the fluid away from the hydro-shearing apparatus;

a pump supported by the frame and adapted to recover at least the fluid emitted from the rotatable nozzle;

a fluid discharge line in communication with the pump and supported by the frame, wherein the fluid discharge line is adapted to permit the transporting of at least the fluid;

a nozzle extension supported by the rotatable nozzle and in communication with the rotatable nozzle, wherein the nozzle extension is adapted to redirect the fluid as it is emitted from the rotatable nozzles;

an eductor ring supported by the frame and adapted to direct fluid downward beneath the hydro-shearing apparatus; and at least one nozzle attached to the eductor ring adapted to direct fluid beneath the hydro-shearing apparatus.

2. The hydro-shearing apparatus of claim 1, further comprising an actuator supported by the frame and having a link in communication with the nozzle extension, wherein the actuator is adapted to reposition the nozzle extension in a substantially vertical plane.

3. The hydro-shearing apparatus of claim 1, further comprising an oscillation mechanism supported by the frame and in communication with the rotatable nozzle, the oscillation mechanism adapted to reposition the rotatable nozzle about a substantially vertical axis.

4. The hydro-shearing apparatus of claim 1, further comprising a screen guard cover supported by the eductor ring and enclosing an intake to the pump.

5. The hydro-shearing apparatus of claim 4, wherein the screen guard cover comprises a plate having holes formed therein.

6. The hydro-shearing apparatus of claim 4, wherein the screen guard cover comprises inter-linked bars.

7. The hydro-shearing apparatus of claim 1, further comprising a screen guard cover supported by the hydro-shearing apparatus and enclosing an intake to the pump.

8. The hydro-shearing apparatus of claim 7, wherein the screen guard cover comprises a plate having holes formed therein.

9. The hydro-shearing apparatus of claim 7, wherein the screen guard cover comprises inter-linked bars.

10. The hydro-shearing apparatus of claim 1, further comprising a cooling mechanism in communication with the fluid supply line and adapted to permit the transporting of fluid to direct fluids onto at least a portion of the pump.

11. The hydro-shearing apparatus of claim 10, wherein the cooling mechanism further comprises at least one nozzle adapted to direct fluids onto at least a portion of the pump.

12. A hydro-shearing apparatus comprising:

a frame;

a fluid supply line supported by the frame and adapted to permit the transporting of fluid;

a rotatable nozzle supported by the frame and in communication with the fluid supply line, wherein the rotatable nozzle is adapted to emit the fluid away from the hydro-shearing apparatus;

a pump supported by the frame and adapted to recover at least the fluid emitted from the rotatable nozzle;

a fluid discharge line in communication with the pump and supported by the frame, wherein the fluid discharge line is adapted to permit the transporting of at least the fluid;

a nozzle extension supported by the rotatable nozzle and in communication with the rotatable nozzle, wherein the nozzle extension is adapted to redirect the fluid as it is emitted from the rotatable nozzle;

a sink ring supported by the frame and in communication with the fluid supply line, wherein the sink ring is adapted to direct fluid downward beneath the hydro-shearing apparatus.

13. The hydro-shearing apparatus of claim 12, wherein the sink ring further comprises at least one nozzle attached to the sink ring adapted to direct fluid downward beneath the hydro-shearing apparatus.

* * * * *